United States Patent [19]

Kubelka

[11] 4,243,163

[45] Jan. 6, 1981

[54] DEVICE FOR DRAWING A BOOT OFF THE FOOT

[75] Inventor: Axel Kubelka, Vienna, Austria

[73] Assignee: Polyair Produkt Design GmbH, Kittsee, Austria

[21] Appl. No.: 16,342

[22] Filed: Feb. 27, 1979

[30] Foreign Application Priority Data

Mar. 3, 1978 [AT] Austria ..... 1543/78

[51] Int. Cl.[3] ..... A47J 51/02

[52] U.S. Cl. ..... 223/115

[58] Field of Search ..... 223/113, 114, 115, 116

[56] References Cited

U.S. PATENT DOCUMENTS

| | | | |
|---|---|---|---|
| 89,633 | 5/1869 | Cullen | 223/115 |
| 3,623,640 | 11/1971 | Zalejski | 223/114 |

FOREIGN PATENT DOCUMENTS

| | | | |
|---|---|---|---|
| 534361 | 3/1941 | United Kingdom | 223/114 |
| 1001980 | 8/1965 | United Kingdom | 223/113 |

*Primary Examiner*—George H. Krizmanich

*Attorney, Agent, or Firm*—Scully, Scott, Murphy & Presser

[57] ABSTRACT

In a boot-jack, the danger of an injuring the uppers of boots is substantially reduced by means of a cladding (4) of elastic material having a Shore hardness of maximum 60 Shore A. The maximum surface pressure exerted is limited by a suitable height dimension of the jaws (6) which are receiving the boot and by a suitable profiling (5) the jaws (6) are well adapted to the outer shape of the boot (FIGS. 1,2).

15 Claims, 13 Drawing Figures

DEVICE FOR DRAWING A BOOT OFF THE FOOT

Figure 2:
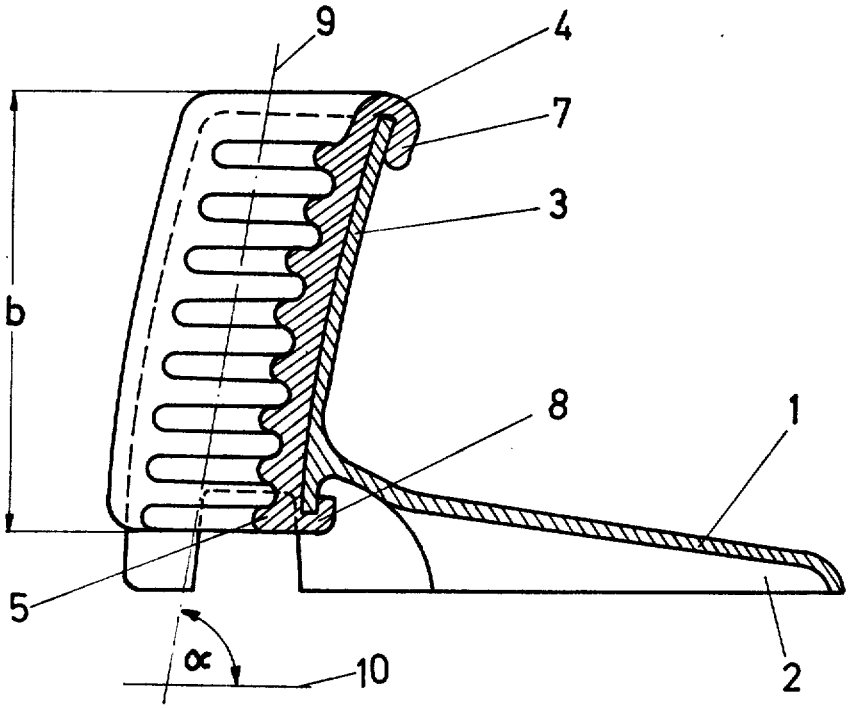

The present invention refers to a device for drawing a boot off the foot, said device comprising jaws partially embracing the boot. Such a device is usually called "boot-jack" and consists of a plate member resting on the floor with a certain inclination, said plate member consisting of wood or cast iron. When drawing off snugly fitted boots with such known devices there exists the danger that the tender uppers becomes scratched and will be detracted from its appearance. Furthermore, with the known devices there exists the danger that the boot becomes torn at its heel portion.

It is now an object of the present invention to improve the known device such that a boot can be drawn off the foot in a simple manner without detracting from the appearance of the surface of leather boots. This object is, according to the invention, essentially achieved by providing the jaws with a cladding of elastic material, noting that the surface of said cladding contacting the boot has a Shore-hardness of maximum 60 Shore A, preferably between 20 and 60 Shore A. Such a cladding of elastic material does care for the surface of the boot and is simultaneously increasing the friction forces between the surface of the boot and the jaws.

The boot must, as was also required with the known devices, be introduced with its heel portion into the jaws, noting that the supporting surface of the device can be pressed against the floor, for example by means of the other foot. Preferably, the cladding consists of an elastomeric synthetic plastics material, preferably polyurethane foam. In this manner a sufficiently high coefficient of friction relative to leather can be achieved.

For better caring for the uppers, above all to make the device suitable for high-heeled ladies boots, it is of particular advantage if the height of the jaws is greater than the inside width and amounts preferably at least to twice the inside width of the jaws. In this manner the engaged length of the heel portion of the boot is substantially increased over known embodiments and the friction contact extends over the total of said length, so that within the individual partial areas of said length the forces exerted on the uppers of the boot are substantially reduced. Preferably, the cladding of the jaws comprises a profiling which is formed of ribs or lamellae arranged at a distance from one another in transverse direction to the axis of the jaws.

This profiling can, however, also be formed of suction cups or inflatable air chambers.

With a profiling comprising ribs or lamellae arranged in a distance from one another it is of advantage if the ribs or lamellae are located along planes which are inclined relative to the axis of the jaws and in direction to the opening of the jaws. In this manner, by compression of the ribs or lamellae there is rapidly obtained a frictional contact which facilitates drawing off the boot without damage. Advantageously, the axis of the jaws is inclined in upward direction and in direction to the bottom of the jaws for an angle of 50 to 70° relative to the resting surface of the device on the floor, so that the movement exerted when drawing off the boot is taken into consideration.

According to a preferred embodiment, the cladding is formed as an insert member which is inserted into a mounting surrounding the jaws and formed of two lateral walls preferably being mutually connected with one another by a web to form an U-shaped profile. In this manner, the device can be manufactured in a simple manner, noting that the lateral walls, and, if desired, also the constructional parts of the device contacting the floor can be formed as separate parts which can be assembled before use. With such an embodiment, it is of advantage if the distance of the lateral walls becomes smaller in upward direction and if the insert member forming the cladding can be shifted between the lateral walls in direction of the height dimension, noting that the shifting path is limited in upward direction. In this case, by shifting the insert member in upward direction, the contact pressure exerted by the cladding on the surface of the boot will be increased. Preferably, the insert member forming the cladding is guided in direction of the shifting movement and secured against leaving the mounting.

The contacting pressure exerted by the cladding of the jaws, on the outer side of the boot can, however, also be increase in a simpled manner by forming the insert member as an inflatable air cushion, the walls of which form the cladding, noting that, again according to an advantageous embodiment, the contacting surface of the device on the floor is formed of an additional deformable air cushion which is in connection with the air cushion or air cushions of the insert member. If, when using such a device, the deformable air cushion, which is provided on the contacting surface of the device on the floor, is compressed by means of the other foot, the air cushions forming the cladding become inflated and are pressed against the outer surface of the boot. However, the contacting pressure exerted by the elastic cladding on the outer surface of the boot can also be varied by any suitable mechanical means and in this case the arrangement can be such that the lateral walls embracing the cladding are arranged for being pressed in direction to one another with keeping open the jaws, noting that preferably a lever is arranged on the contacting surface of the device on the floor for being swivelled around an axis arranged in essentially parallel relation to the contacting surface (base plate) of the device, and that said lever is via ropes and, respectively, or further levers in connection with the movable lateral walls.

In a particularly simple manner the arrangement can be such that the constructional part carrying the cladding is connected to the base plate for swivelling movement and is secured in its operating position by stops.

In the following, the invention is further illustrated with reference to various embodiments shown in the drawing and illustrating further details essential for the present invention.

Figure 1:
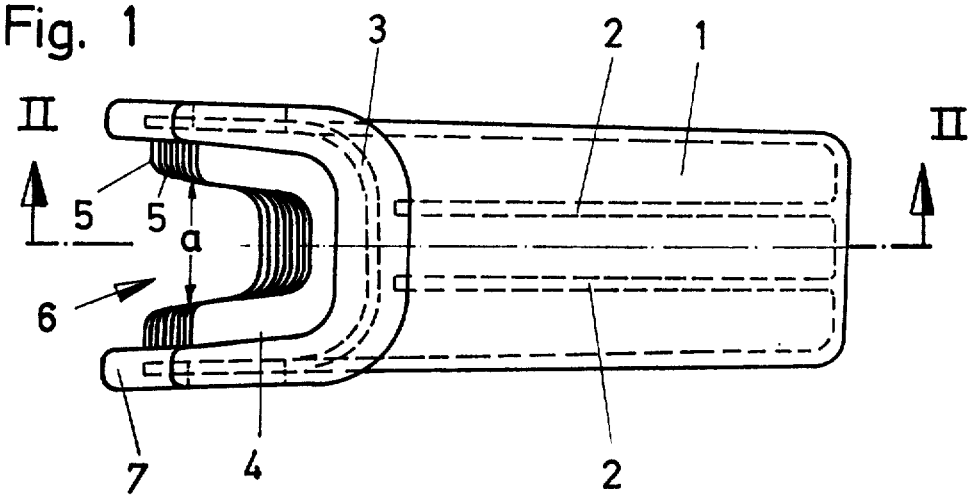
Figure 4:
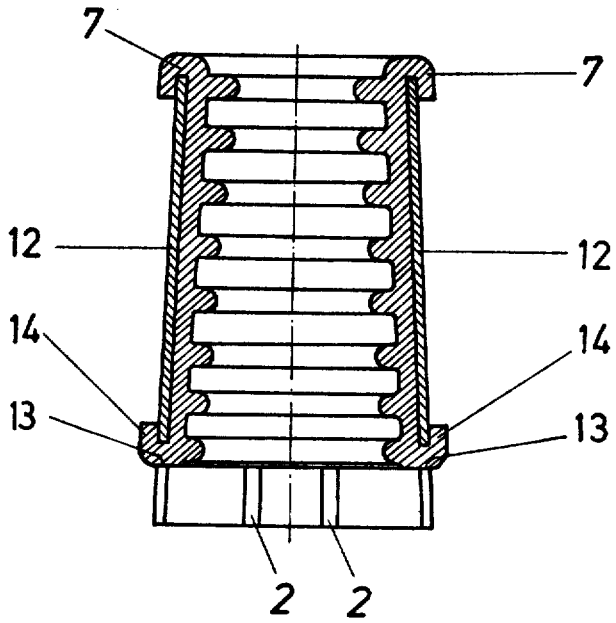
Figure 3:
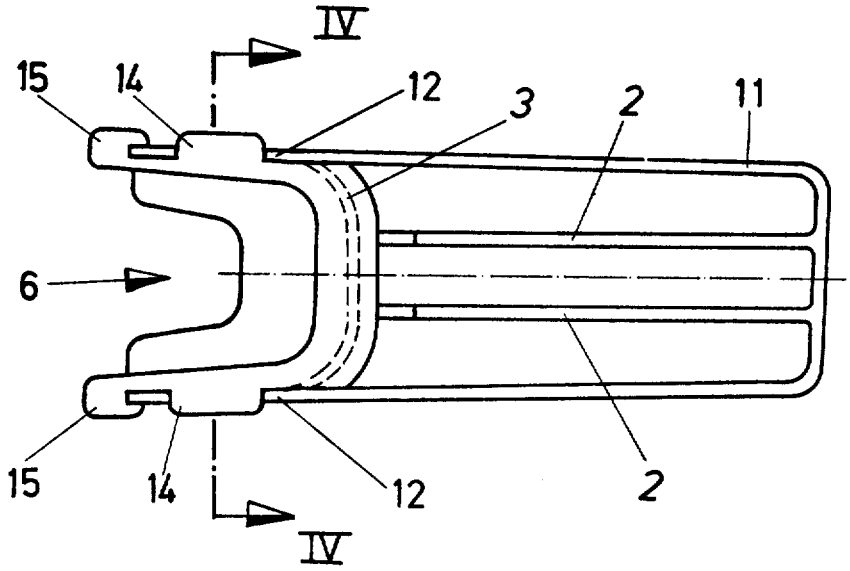
Figure 5:
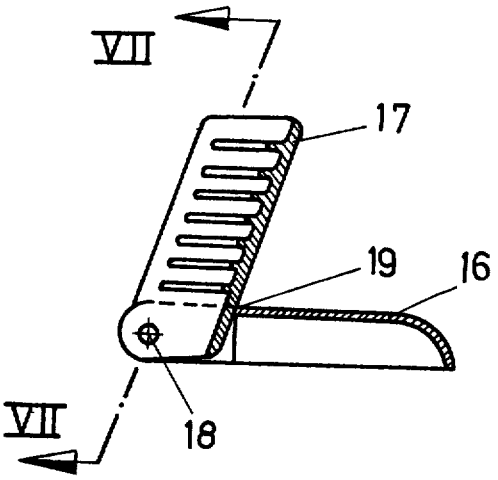
Figure 6:
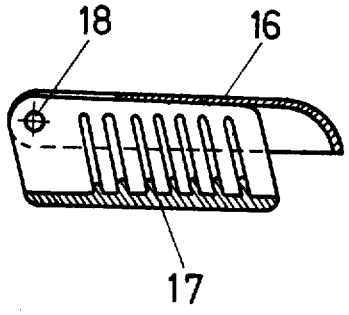
Figure 7:
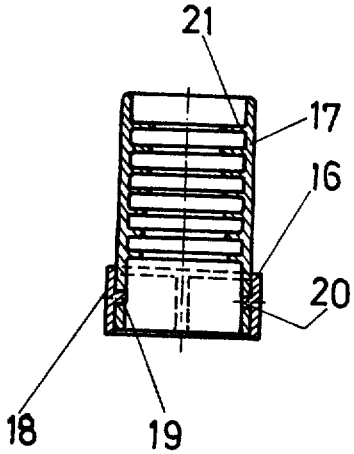
Figure 9:
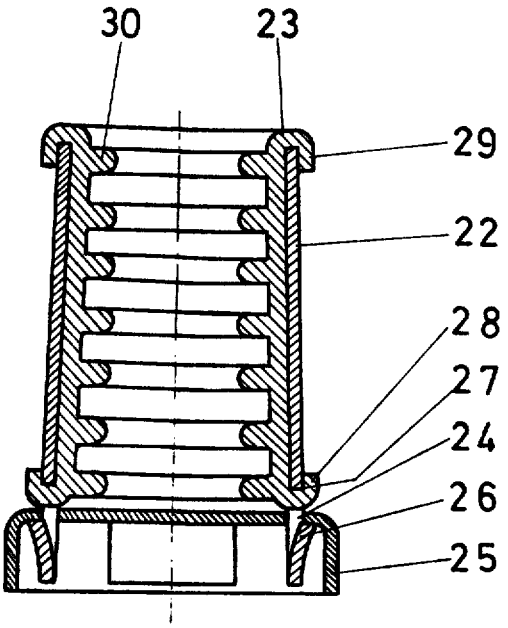
Figure 8:
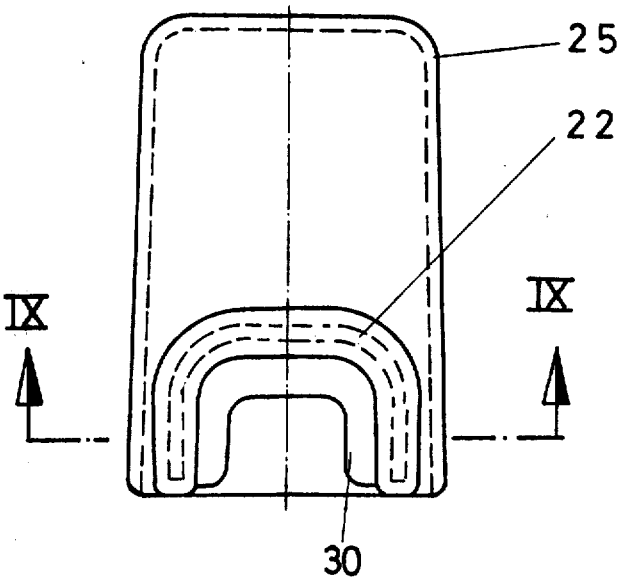
Figure 11:
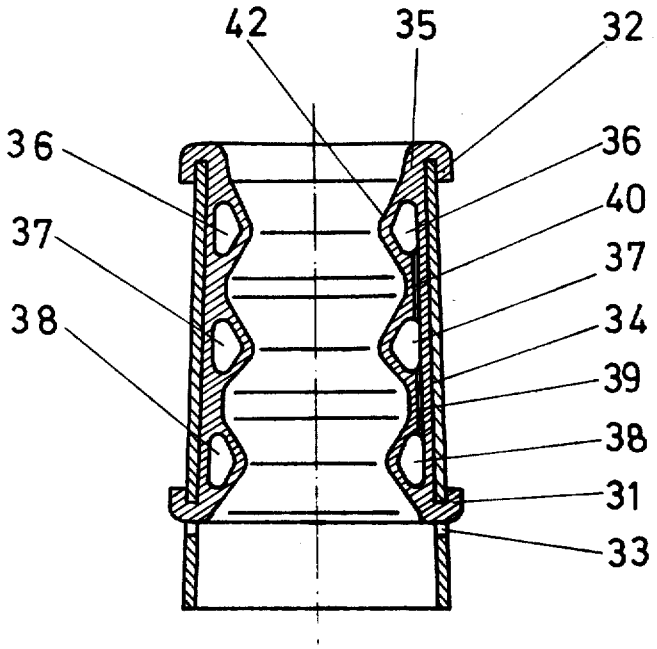
Figure 10:
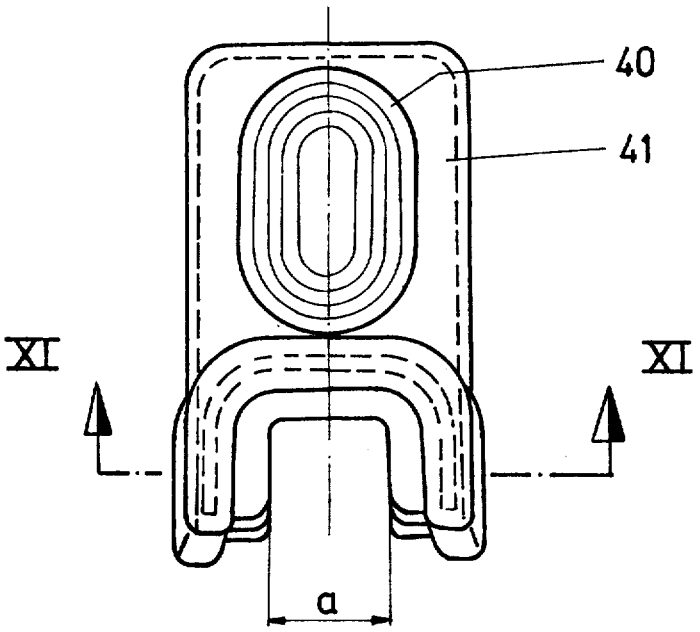
Figure 12:
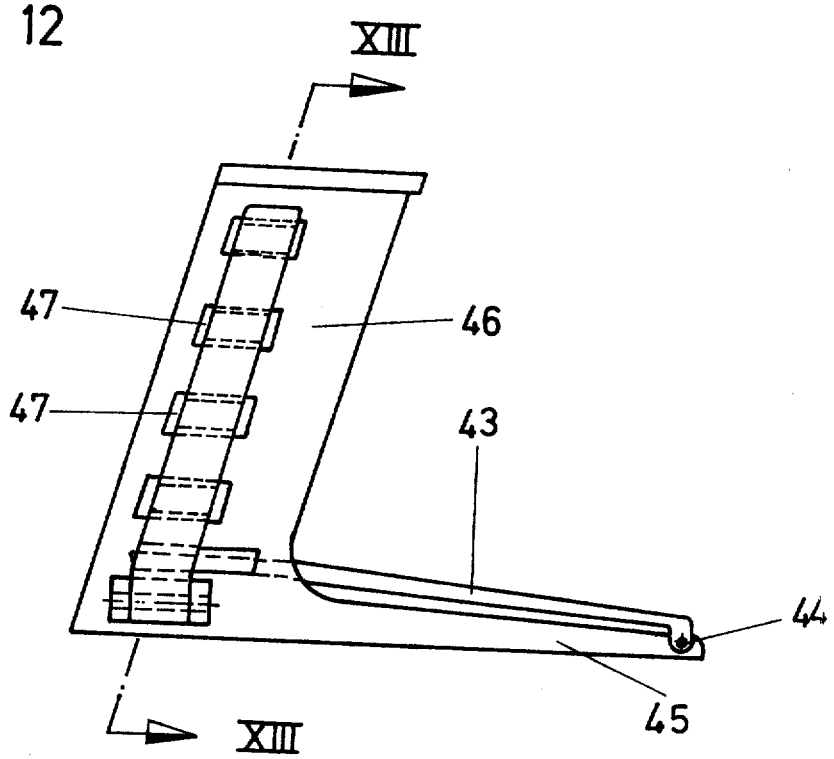
Figure 13:
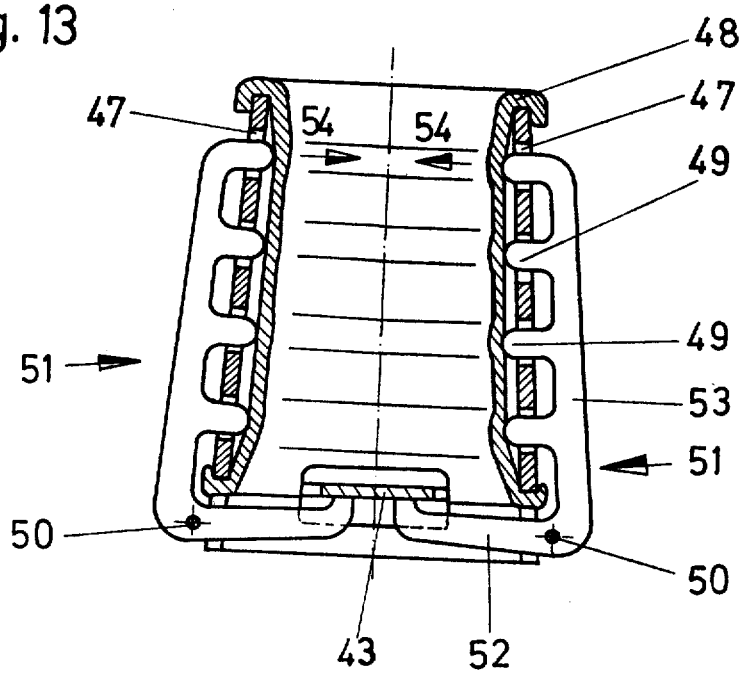

In the drawing,

FIGS. 1, 2, 3 and 4 illustrate a first embodiment, noting that FIG. 1 is a top plan view, FIG. 2 is a section along line II—II of FIG. 1, FIG. 3 is a view as seen from the bottom and FIG. 4 is a section along line IV—IV of FIG. 3, FIGS. 5, 6 and 7 show a further collapsible embodiment, noting that FIGS. 5 and 6 are lateral views partially in section and FIG. 7 is a section along line VII—VII of FIG. 5, FIGS. 8 and 9 show a still further embodiment, noting that FIG. 8 is a top plan view and FIG. 9 is a section along line IX—IX of FIG. 8, FIGS. 10 and 11 illustrate an embodiment comprising inflatable air cushions, noting that FIG. 10 is a top plan view and FIG. 11 is a section along line XI—XI of FIG. 10 and FIGS. 12 and 13 show an embodiment in which the cladding is pressed by swivelling levers for becoming narrower, noting that FIG. 12 is a side view and FIG. 13 is a section along line XIII—XIII of FIG. 12.

In FIG. 1 the reference numeral 1 designates the base plate. The base plate 1 is provided with ribs 2 in its middle portion for increasing its dimensional stability, said ribs 2 contacting the floor when using the device as do the edges of the base plate. A protrusion 3 is extending in upward direction from base plate 1 as is clearly shown in FIG. 2. This protrusion 3 serves the purpose of positioning the elastic cladding 4 of the jaws. This elastic cladding 4 comprises lamellae 5 defining said jaws 6. The inner width a of the jaws amounts to approximately ⅓ of the height dimension of the jaws. The elastic cladding 4 embraces with its borders 7 and 8 the rigid parts of the base plate 1 and of the upwardly directed protrusion 3 and thus is reliably locked in position. The axis 9 of the jaws 6 is inclined to the plane 10 of the floor for an angle of approximately 75° . When putting the heel portion (not shown) of a boot into the jaws 6 and when the device is, for example by pressing the base plate 1 in downward direction by the other foot, kept in position, the lamellae 5 of the elastic cladding 4 are pressed against the outer surface of the boot, thus enabling drawing off the boot in a simple and leather-saving manner.

As is shown in FIGS. 3 and 4, the ribs 11 at the edges of the base plate pass over into the lateral wall areas 12 which form together with the upward extending protrusions 3 the mounting embracing the jaws. The lateral wall areas 12 are provided with openings 13 through which extend flaps 14 of the elastic cladding for reliably anchoring the cladding. The edges 15 of the elastic cladding which are facing the open side of the jaws, are gripping over the lateral wall areas 12 of the ribs 11 of the base plate 1.

In the embodiments shown in FIGS. 5, 6 and 7, the base plate is designated 16. The constructional part 17 comprising the cladding is linked to this base plate 16 for being swivelled around an axis 18. By swivelling the constructional part 17 carrying the cladding around axis 18, the position illustrated by FIG. 6 can be obtained in which the open side of the jaws is located beneath the base plate 16. The base plate 16 is provided with stops 19 which delimit the operating position of the constructional part 17 carrying the cladding. In this operating position, th axis of the jaws includes with the plane of the floor an angle of approximately 60° . As is shown in FIG. 7 the pivotal axis 18 is formed of short pins 19 of the base plate 16 which engage corresponding recesses 20 of the constructional part 17 carrying the cladding. The lamellae are designated 21.

In the embodiment according to FIGS. 8 and 9, the mounting 22 for the cladding 23 of elastic material is put through openings 24 of the base plate 25 and locked behind these openings 24 at 26. The mounting 22 again has openings 27 through which extend protrusions 28 of the elastic cladding 23, noting that these protrusions 28 are gripping behind these openings 27. Also at the upper edge of the cladding 23 this cladding is fixed to the mounting 22 by portions 29 gripping over said edge. The elastic cladding again has lamellae 30. As can be seen in the top plan view shown in FIG. 8, the mounting has substantially EU-shaped form which serves the purpose of stiffening the jaws on all its sides.

In the embodiment according to FIGS. 10 and 11, anchoring of the cladding on the mounting is established in similar manner as in the embodiments already described. There again, overlapping rims 31 and 32 are provided. Rim 31 is pushed through an opening 33 of the mounting 34 while rim 32 of the elastic cladding is gripping the upper edge of the mounting 34. The elastic cladding 35 has chambers 36, 37 and 38 which are mutually interconnected via passages 39 and 40. These chambers 36,37 and 38 are additionally connected in a manner not shown with an air cushion 40 provided on the base plate 41. Compression of the air cushion 40 will thus effect inflating of the chambers 36, 37 and 38. The inner wall 42 of the elastic cladding 35 provides, as can be seen in the section shown in FIG. 11, a lamella-shaped profile. The opposed portions of the inner wall 42 are pressed one against the other when inflating the air chambers 36,37,38 whereby the inner width a of the jaws becomes reduced.

In the embodiments shown in FIGS. 12 and 13, a lever 43 is linked to the base plate 45 to be swivelled around an axis 44 which is arranged in essentially parallel relation to the plane of the floor. The base plate 45 is passing over into walls 46 laterally delimiting the jaws and being provided with openings 47. A cladding 48 of an elastomeric synthetic plastics material is applied to these walls 46. Fingers 49 of a lever 51, which is arranged for being swivelled around an axis 50, extend through these openings 47, said lever 51 being essentially L-shaped. One leg 52 of this crank lever 51 can be moved in downward direction and in direction to the base plate by moving the lever 43 in downward direction by means of a foot, so that the second leg 53 carrying the fingers 49 is inwardly moved in direction of arrow 54. The pair of crank levers 51 is thus pressed like tongs in direction one to the other and warrant a reliable friction contact between a boot put into the jaws and the material of the elastic cladding 48.

What I claim is:

1. Device for drawing a boot off the foot, comprising jaws partially embracing the boot, characterized in that the height of the jaws is greater than its inside width, the jaws are provided with a cladding of elastomeric synthetic plastic material which is profiled with ribs arranged one above the other in a direction transverse to the axis of the jaws, the surface of said cladding contacting the boot has a Shore-hardness of maximum 60 Shore A, preferably between 20 and 60 Shore A.

2. Device as claimed in claim 1, characterized in that the cladding consists of polyurethane foam.

3. Device as claimed in claim 1 or 2, characterized in that the dimension of the jaws in height direction is at least twice its inner width.

4. Device as claimed in claim 1, characterized in that the ribs are located in planes which are inclined in direction to the opening of the jaws and relative to the axis of the jaws.

5. Device as claimed in claim 1, characterized in that the profiling is formed of suction cups.

6. Device as claimed in claim 1, characterized in that the axis of the jaws is inclined in upward direction and in direction to the bottom of the jaws for an angle of 50° to 70° relative to the resting surface of the device on the floor.

7. Device as claimed in claim 1, characterized in that the cladding is formed as an insert member which is inserted into a mounting surrounding the jaws and formed of two lateral walls preferably being mutually connected with one another by a web to form a U-shaped profile.

8. Device as claimed in claim 7, characterized in that the insert member comprises protrusions which can be locked in openings of the mounting.

9. Device as claimed in claim 7, characterized in that the insert member comprises inflatable air cushions the walls of which form the cladding.

10. Device as claimed in claim 9, characterized in that the supporting part of the device comprises a further deformable air cushion which is connected with the air cushion or the air cushions of the insert member.

11. Device as claimed in claim 1, characterized in that the side walls embracing the cladding are adapted for being pressed one against the other thereby keeping free the opening of the jaws.

12. Device as claimed in claim 11, characterized in that a lever is linked to the supporting surface of the device on the floor for being swivelled around an axis arranged in essentially parallel relation to the supporting surface and that this lever is in connection with the movable side walls via ropes and, respectively, or additional levers.

13. Device as claimed in claim 1, characterized in that the distance of the side walls is decreasing in upward direction and in that the insert member forming the cladding is arranged for being shifted between the side walls in upward and downward direction, noting that the shifting path in upward direction is limited.

14. Device as claimed in claim 1, characterized in that the insert member forming the cladding is guided in shifting direction and secured against leaving the mounting.

15. Device as claimed in claim 1, characterized in that the constructional part carrying the cladding is fixed to the supporting plate (base plate) for swivelling movement and secured to its operating position by means of stops.

* * * * *